US008232948B2

(12) United States Patent
Yin et al.

(10) Patent No.: US 8,232,948 B2
(45) Date of Patent: Jul. 31, 2012

(54) MULTILEVEL VOLTAGE DRIVING DEVICE

(75) Inventors: Xinshe Yin, Beijing (CN); Ming Chen, Beijing (CN)

(73) Assignee: Beijing Boe Optoelectronics Technology Co., Ltd. (CN)

( * ) Notice: Subject to any disclaimer, the term of this patent is extended or adjusted under 35 U.S.C. 154(b) by 1259 days.

(21) Appl. No.: 11/958,517

(22) Filed: Dec. 18, 2007

(65) Prior Publication Data

US 2008/0291148 A1 Nov. 27, 2008

(30) Foreign Application Priority Data

May 22, 2007 (CN) ..... 2007 1 0099470

(51) Int. Cl.
*G09G 3/36* (2006.01)

(52) U.S. Cl. ..... 345/94; 345/100; 327/333; 326/63

(58) Field of Classification Search ..... 345/87, 345/94–100; 327/333; 326/63, 68, 80
See application file for complete search history.

(56) References Cited

U.S. PATENT DOCUMENTS 5,818,406 A 10/1998 Tsuchi et al.

FOREIGN PATENT DOCUMENTS

| | | | |
|---|---|---|---|
| CN | 1470929 | A | 1/2004 |
| CN | 1622435 | A | 6/2005 |
| EP | 0395387 | A2 | 10/1990 |
| GB | 2161012 | A | 1/1996 |
| JP | S60-249191 | A | 12/1985 |
| JP | H2-282788 | A | 11/1990 |
| JP | H8-160916 | A | 6/1996 |
| JP | 2003-215630 | A | 7/2003 |
| KR | 10/0665326 | | 1/2007 |
| KR | 10/0700415 | | 3/2007 |

*Primary Examiner* — Seokyun Moon
(74) *Attorney, Agent, or Firm* — Sheridan Ross P.C.

(57) ABSTRACT

Provided is a multilevel voltage driving device and system. The multilevel voltage driving device comprises a level converter, which is provided with an AC signal input terminal for inputting an AC signal, a high level output terminal for outputting a high level, and an intermediate level output terminal for outputting an intermediate level; and a switch selector, which is connected with the high level output terminal and the intermediate level output terminal, and which is provided with a control signal input terminal, for inputting a control signal to alternately select the high level and intermediate level, and an output terminal for outputting the selected level.

7 Claims, 5 Drawing Sheets

MULTILEVEL VOLTAGE DRIVING DEVICE

BACKGROUND OF THE INVENTION

The present invention relates to a multilevel voltage driving device for a liquid crystal display (LCD).

In a thin film transistor-liquid crystal display (TFT-LCD), image display is performed by active control on individual pixels on a display panel with a preset TFT array thereon.

FIG. 1 is a schematic diagram showing the circuit connection of a pixel in the liquid crystal display panel, which comprises a TFT 101. The gate G of the TFT 101 is connected with a scan line SL, the drain D is connected with a data line DL, and the source S is connected with a pixel electrode and a storage capacitor $C_{st}$. In addition, the pixel electrode, a counter electrode, and a liquid crystal layer interposed therebetween together form a liquid crystal capacitor $C_{LC}$. The pixel electrode of the liquid crystal capacitor $C_{LC}$ is connected with the source S of the TFT 101, and the counter electrode is connected with a common electrode $V_{COM}$.

When the pixel is charged, as shown in FIG. 2, the scan line is at a high level, which is typically about 20 V, so that with the level over the data line output from the source driving IC, the liquid crystal capacitor $C_{LC}$ and the storage capacitor $C_{st}$ is charged through the TFT 101. When the level on the liquid crystal capacitor $C_{LC}$ reaches a predetermined value, the scan line SL is switched to a low level and the TFT 101 is turned off. In order to completely turn off the TFT 101, a low level of −5V~−10V should be maintained on the scan line SL. When the TFT 101 is turned off, the level across the pixel is maintained. When the scan line SL is switched to a high level upon the next scanning, the corresponding TFT will be turned on again, and the corresponding pixel will be charged or discharged.

When the pixel is charged, a scan line level of about 20-30V, which is higher than that applied to the pixel after the charging is completed, is applied to the gate G of the TFT 101. Since during the process of charging, a parasitic capacitor $C_{gs}$ is produced between the gate G and the source S of the TFT 101, so that the charge/discharge direction of the parasitic capacitor $C_{gs}$ changes as the level on the scan line changes from a high level to a low level. At the instant when the TFT 101 is turned off, the polarity of the parasitic capacitor $C_{gs}$ will be changed and the charges between the liquid crystal capacitor $C_{LC}$ and the storage capacitor $C_{st}$ will be redistributed. As a result, at the instant when the scan line turns from the high level to the low one, the level across the liquid crystal layer forms a jump level ΔVp, which changes with the level change on the scan line according to the following expression:

$$\Delta V_p = \frac{C_{gs}}{C_{gs} + C_{LC} + C_{st}} \Delta V_g$$

where ΔVg is the level difference between the high level and the low level on the scan line.

Due to presence of the jump level ΔVp, it is prone to give rise to flickering of the liquid crystal display panel. In a conventional technology, a multilevel voltage is usually adopted to reduce the value of the jump level ΔVp. FIG. 3 shows the charging diagram after a multilevel voltage is applied to the data line. When the scan line is changed from the high level to the low level, an intermediate level is inserted between the high level and the low level. Since the difference between the high level and the intermediate level is relatively small, ΔVp 1 is also small. At this time, the TFT is not turned off yet, and with the level on the data line, the pixel is charged continuously through the TFT, so that the level across the pixel will continue to increase by ΔV again. Next, the level on the scan line further is changed from the intermediate level to a negative level so as to turn off the TFT, and a jump level ΔVp2 is also generated across the pixel. Therefore, the jump level across the pixel during the whole process is $\Delta V_P = \Delta V_{P1} - \Delta V + \Delta V_{P2}$. It can be seen that the jump level ΔVp across the pixel becomes smaller after the scan line takes a multilevel voltage.

The drawbacks of the conventional method lies in that the driving device used to produce a multilevel voltage on the scan line is realized with an integrated operational amplifier, and the relatively high cost of the integrated operational amplifier correspondingly results in the high cost of the current multilevel voltage driving device.

SUMMARY OF THE INVENTION

In view of the above problems, there is a need for a multilevel voltage driving circuit with low cost.

According to the first aspect of the present invention, there is provided a multilevel voltage driving device, comprising a level converter, which is provided with an AC signal input terminal for inputting an AC signal, a high level output terminal for outputting a high level, and an intermediate level output terminal for outputting an intermediate level; and a switch selector, which is connected with the high level output terminal and the intermediate level output terminal and which is provided with a control signal input terminal, for inputting a control signal to alternately select the high level and intermediate level, and an output terminal for outputting the selected level.

According to the second aspect of the present invention, there is provided a multilevel voltage driving system, comprising the above multilevel voltage driving device, and further comprising an AC signal source, which is connected with the AC signal input terminal of the multilevel voltage driving device.

Preferably, the multilevel voltage driving system further comprises a reference level signal source, which is connected with a reference level input terminal of the multilevel voltage driving device.

Preferably, the multilevel voltage driving system further comprises a control signal source, which is connected with the control signal input terminal of the multilevel voltage driving device.

According to the third aspect of the present invention, there is provided a multilevel voltage driving device, comprising: a level converter, which is provided with an AC signal input terminal for inputting an AC signal and a high level output terminal for outputting a high level; and a switch selector, which is connected with the high level output terminal, and which is provided with an intermediate level output terminal connected with an intermediate level, a control signal input terminal, for inputting a control signal to alternately select the high level and the intermediate level, and an output terminal for outputting the selected level.

According to the present invention, it is possible to generate driving levels having multilevel voltage value. Compared with the driving device realized by an integrated operational amplifier in the conventional method, the multilevel voltage driving device or system according to the embodiments of the present invention can be realized by discrete components, and therefore has lower cost and lower power consumption.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the following detailed description.

BRIEF DESCRIPTION OF THE DRAWING

The present invention will become more fully understood from the detailed description given hereinafter and the accompanying drawings which are given by way of illustration only, and thus are not limitative of the present invention and wherein.

DESCRIPTION OF THE PREFERRED EMBODIMENTS

Figure 1:
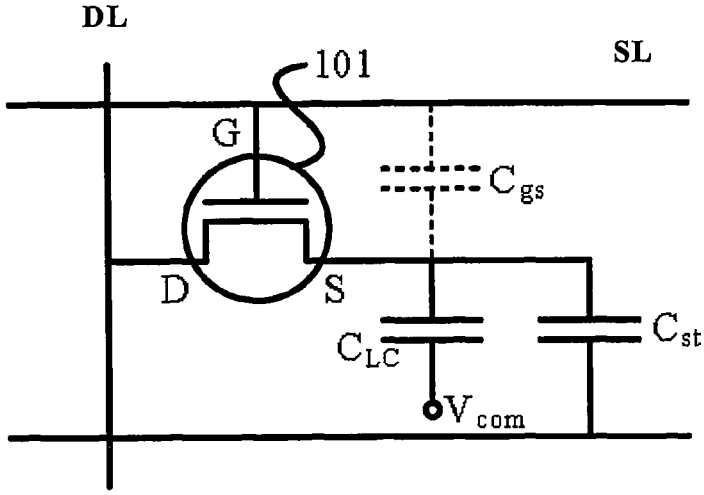
FIG. 1 is a schematic view showing the circuit connection structure of a pixel in a conventional liquid crystal display panel.
Figure 2:
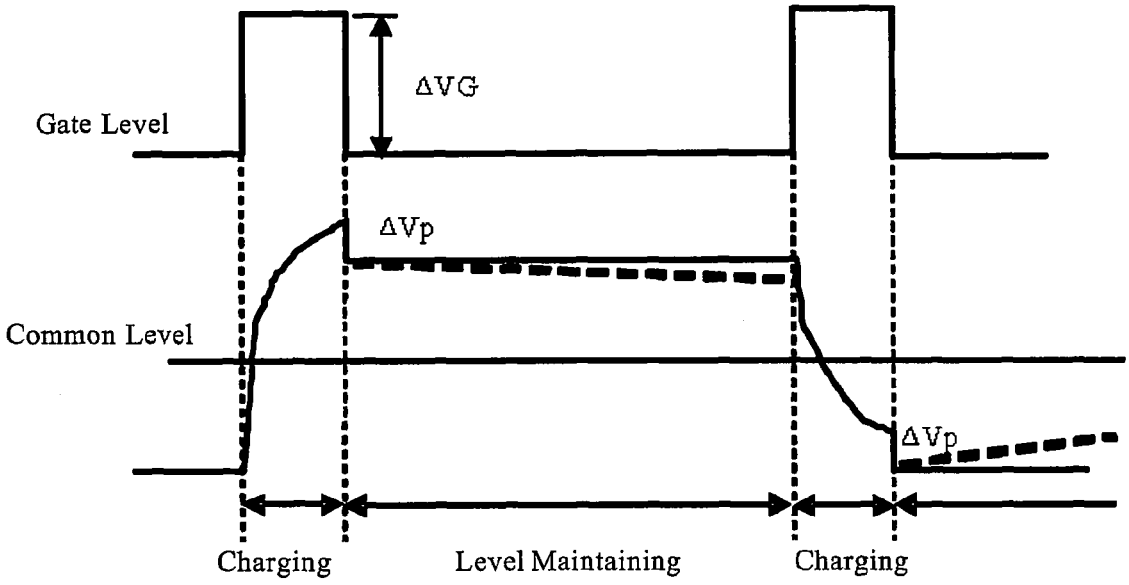
FIG. 2 is a schematic showing a voltage waveform when the pixel is charged in a conventional method.
Figure 3:
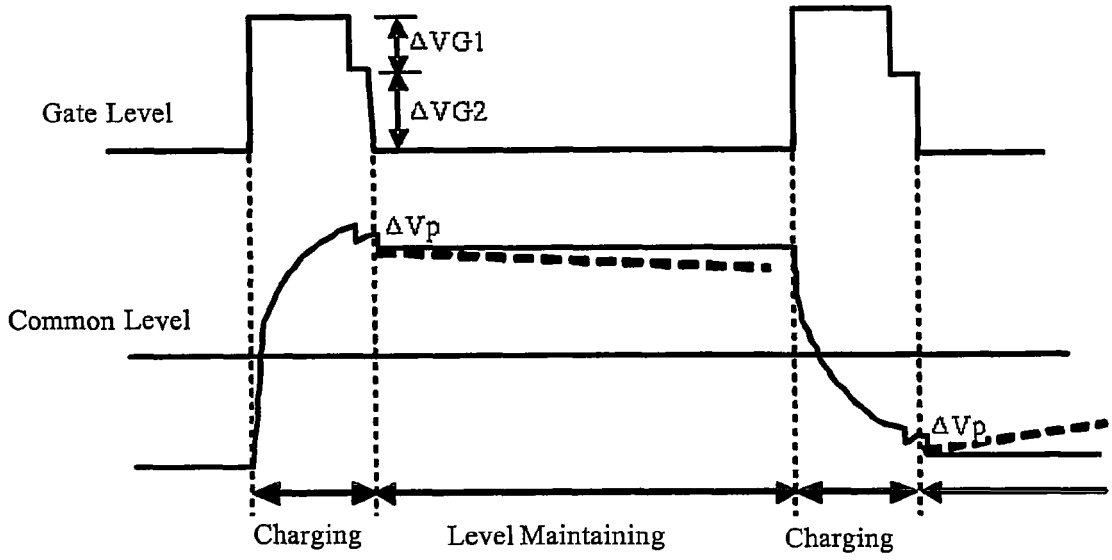
FIG. 3 is a diagram showing a voltage waveform when the pixel is charged with multi-level driving voltages in a conventional method.
Figure 4:
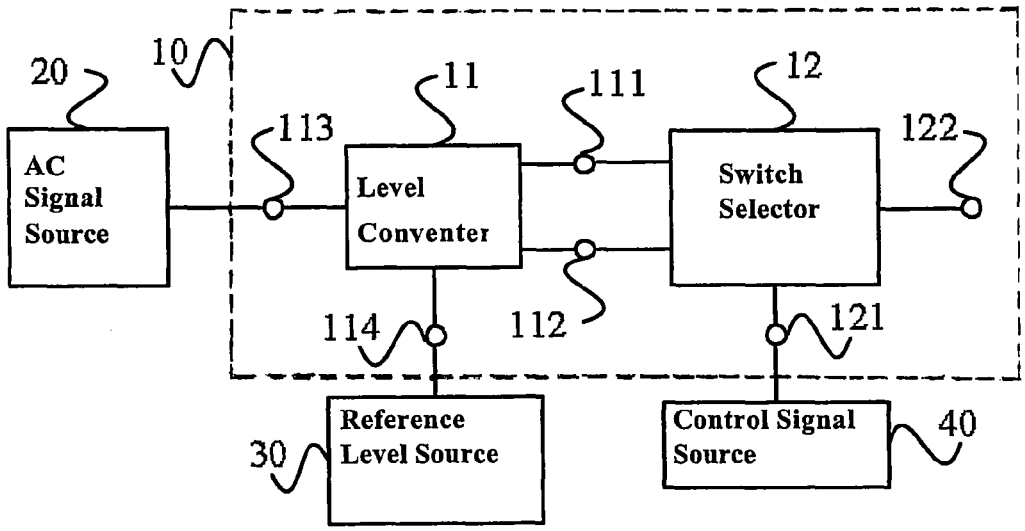
FIG. 4 is a structural diagram showing a multilevel voltage driving device according to an embodiment of the present invention.

A multilevel voltage driving device is provided according to an embodiment of the present invention, as shown in FIG. 4.

The multilevel voltage driving device 10 comprises a level converter 11 and a switch selector 12. Herein, the level converter 11 has an AC signal input terminal 113 connected with an AC signal source 20, a high level output terminal 111 for outputting a high level, and an intermediate level output terminal 112 for outputting an intermediate level. The switch selector 12 is connected with the high level output terminal 111 and the intermediate level output terminal 112. The multilevel voltage driving device 10 operates in the following manner.

The level converter 11 boosts a high voltage value $V_{AC}$ of the AC signal output from the AC signal source 20 and in turn outputs the boosted voltage as a high level $V_{GH}$ to the switch selector 12 via the high level output terminal 111; at the same time, the level converter 11 outputs the high voltage value $V_{AC}$ of the AC signal output from the AC signal source 20 as an intermediate level $V_{GM}$ to the switch selector 12 via the intermediate level output terminal 112. Herein, the AC signal can be a sinusoidal wave signal or a square wave signal.

The level converter 11 is a level converter which multiplies the input level and adjusts the output level with a diode and charging/discharging of a capacitor. In particular, an input AC signal is input into the level converter, and the voltage of the output high level $V_{GH}$ can be converted into a value twice or more of the magnitude of the input high voltage value of the AC signal. If the magnitude of the converted high level $V_{GH}$ is twice of that of high voltage value of the AC signal, the level converter 11 can be functionally called a 2× level converter. Generally, a 2× level converter is sufficient for use in a TFT-LCD.

The switch selector 12 has a control signal input terminal 121 for connecting with a control signal source 40. The switch selector 12 alternately selects the high level $V_{GH}$ and the intermediate level $V_{GM}$ from the level converter 11 on the basis of the control signal input by the control signal source 40, and outputs selected levels via the output terminal 122, i.e., outputs driving level having two levels of voltage of the output high level $V_{GH}$ and the intermediate level $V_{GM}$.

Furthermore, to flexibly adjust the two levels of voltage for the driving level, the level converter 11 can also be provided a reference level input terminal 114 for inputting a reference level $V_{REF}$ for the high level $V_{GH}$ and the intermediate level $V_{GM}$. For example, when the level converter 11 is a 2× level converter, the corresponding high level $V_{GH}=2V_{AC}+V_{REF}$, and the intermediate level $V_{GM}=V_{AC}+V_{REF}$.

Figure 5:
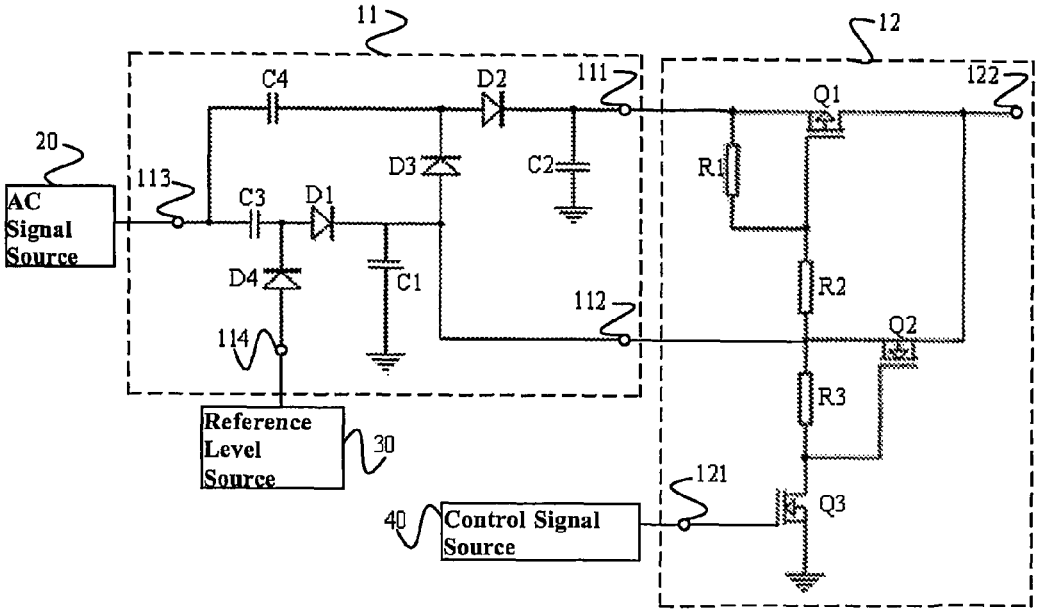
FIG. 5 is a diagram showing a circuit connection which can be adopted in the multilevel voltage driving device according to an embodiment of the present invention.

A circuit diagram, which can be adopted in the multilevel voltage driving device 10 according to the embodiment of the present invention, as shown in FIG. 5, will be described in detail in the following.

The level converter 11 comprises two branches in parallel, the terminals of these branches being connected with the AC signal input terminal 113 and the ground, respectively. One of the branches sequentially comprises a third capacitor C3, a first diode D1, and a first capacitor C1 connected in series, and the other branch sequentially comprises a fourth capacitor C4, a second diode D2, and a second capacitor C2 connected in series. One terminal of the first capacitor C1 is connected with the ground and the other terminal is connected with the negative electrode of the first diode D1. One terminal of the second capacitor C2 is connected with the ground, and the other terminal is connected with the negative electrode of the second diode D2. The negative electrode of the first diode D1 is connected with the intermediate level output terminal 112. The negative electrode of the second diode D2 is connected with the high level output terminal 111. The positive electrode of the third diode D3 is connected with the intermediate level output terminal 112, and the negative electrode of the third diode D3 is connected with the positive electrode of the second diode D2. The negative electrode of the fourth diode D4 is connected with the positive electrode of the first diode D1, and the positive electrode of the fourth diode D4 is connected with the reference level signal source 30 via the reference level input terminal 114.

When the level converter 11 sets out to operate, the AC signal source 20 inputs an AC signal via the AC signal input terminal 113, and this AC signal can be a sinusoidal wave signal or a square wave signal. When the AC signal output by the AC signal source 20 is at a low level, the reference level signal source 30 inputs a reference level $V_{REF}$ via the reference level input terminal 114 for charging the third capacitor C3 via the fourth diode D4, so as to charge the right side of the third capacitor C3 with positive charges and the left side of the third capacitor C3 with negative charges. Therefore, the voltage value of the third capacitor C3 is made equal to the reference level $V_{REF}$. When the AC signal source 20 outputs a high level of $V_{AC}$, since the third capacitor C3 has been charged with charges corresponding to the voltage value $V_{REF}$, the right side of the third capacitor C3 reaches a voltage value of $V_{REF}+V_{AC}$. Therefore, the fourth diode D4 is turned off, the reference level no longer charges the third capacitor C3, while the first diode D1 is turned on, and therefore the charges on the third capacitor C3 will charge the first capacitor C1 via the first diode D1. Due to the unidirectional conducting of the diode, charges corresponding to the voltage value of $V_{REF}+V_{AC}$ are maintained on the first capacitor C1. When the AC signal is at a low level, the right side of the third capacitor C3 decreases below the reference level, the first diode D1 is turned off and the fourth diode D4 is turned on, so that the reference level $V_{REF}$ will charge the third capacitor C3 again via the fourth diode D4. Since the first diode D1 is turned off at this time, when the AC signal is at a low level, the charges on the first capacitor C1 will be maintained and will be output as the intermediate level $V_{GM}$ via the intermediate level output terminal 112.

With the similar operation principle, the intermediate level $V_{GM}$ acts as a reference level for the branch comprising the fourth capacitor C4, the second diode D2 and the second capacitor C2 connected in series. When the AC signal output from the AC signal source 20 is at a low level, the intermediate level $V_{GM}$ charges the fourth capacitor C4 via the third diode D3, so that the voltage value on the fourth capacitor C3 equals to the intermediate level $V_{GM}$. When the AC signal output from the AC signal source 20 is at a high level, the voltage value at the right side of the fourth capacitor C4 is raised to $V_{REF}+2V_{AC}$ which will charge the second capacitor C2 via the second diode D2, and a voltage value of $V_{REF}+V_{AC}$ is maintained on the second capacitor C2 due to the unidirectional conducting of the diode. The voltage value maintained on the second capacitor C2 is output as a high level $V_{GH}$ via the high level output terminal 111.

The setting of the voltage value of the high level $V_{GH}$ and the intermediate level $V_{GM}$ is realized by changing the reference level $V_{REF}$. The reference level $V_{REF}$ is a direct current (DC) signal and the voltage value thereof can be at a positive level or a negative level.

The switch selector 12 comprises a first switch Q1, a second switch Q2, and a third switch Q3 so as to alternately select the high level $V_{GH}$ and the intermediate level $V_{GM}$ from the level converter 11. Herein, the first switch Q1, the second switch Q2, and the third switch Q3 can be a field effect transistor (FET), a bipolar junction transistor, or other types of switch. In particular, in FIG. 5, an FET is described as an example. However, in case that a bipolar junction transistor or other types of switch are adopted, the operating principle is basically the same, which is not described herein for simplicity.

In FIG. 5, the first switch Q1 is a P type FET, and the second switch Q2 and the third switch Q3 both are N type FET. The output terminal drain of the first switch Q1 is connected with the output terminal drain of the second switch Q2, and the input terminal source of the first switch Q1 is connected with the high level output terminal 111 of the level converter 11. The input terminal source of the second switch Q2 is connected with the intermediate level output terminal 112 of the level converter 11. With respect to the third switch Q3, the control terminal gate is connected with the control signal source 40 via the control signal input terminal 121, the input terminal source is connected with the ground, and the output terminal drain is connected with the gate of the second switch Q2 and is connected with the control terminal gate of the first switch Q1 via a third resistor R3 and a second resistor R2 connected in series. Here, the third resistor R3 is connected between the input terminal source and the control terminal gate of the second switch Q2. In addition, a first resistor R1 can also be connected between the input terminal source and the control terminal gate of the first switch Q1. The resistors R1, R2, and R3 mentioned above can be used to adjust the voltage value of the operating point for the first switch Q1 and the second switch Q2.

When the switch selector 12 sets out to operate, the control signal source 40 inputs a control signal via the control signal input terminal 121. The switch selector 12 receives the high level $V_{GH}$ and the intermediate level $V_{GM}$ from the level converter 11 via the high level output terminal 111 and the intermediate level output terminal 112, respectively, then alternately selects the high level $V_{GH}$ and the intermediate level $V_{GM}$ under the control of a control signal, and outputs the selected level via the output terminal 122, generating driving levels having two levels of voltage.

Figure 6:
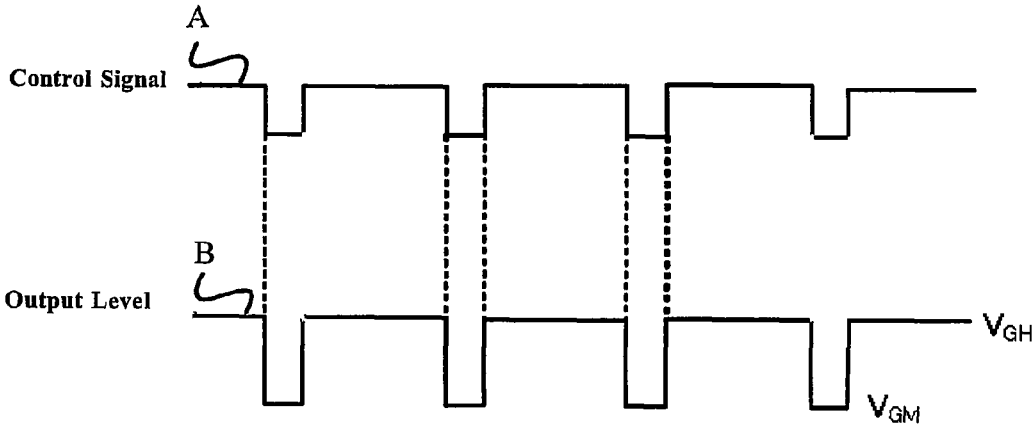
FIG. 6 is a waveform of the output voltage of the multilevel voltage driving device illustrated in FIG. 5.

When the control signal is at a high level, the first switch Q1 and the third switch Q3 are turned on while the second switch Q2 is turned off, and the output terminal 122 outputs a high level $V_{GH}$. When the control signal is at a low level, the first switch Q1 and the third switch Q3 are turned off while the second switch Q2 is turned on, and the output terminal 122 outputs an intermediate level $V_{GM}$. In particular, the signal waveform output form the output terminal 122 is shown in FIG. 6, in which when the control signal is at a low level, the voltage value of the output terminal 122 is the intermediate level $V_{GM}=V_{REF}+V_{AC}$, and when the control signal is a high level, the voltage value of the output terminal 122 is at the high level $V_{GH}=V_{REF}+2V_{AC}$.

If the desired output intermediate level of the multilevel voltage driving device is 0V or a preset level (for example, Vref), such output intermediate level of 0V or the preset level can be obtained by disconnecting the intermediate level output terminal 122 of the level converter 11 with the intermediate level input terminal of the switch selector 12 and then connecting the intermediate level input terminal of the switch selector 12 with the ground or the preset level.

Figure 7:
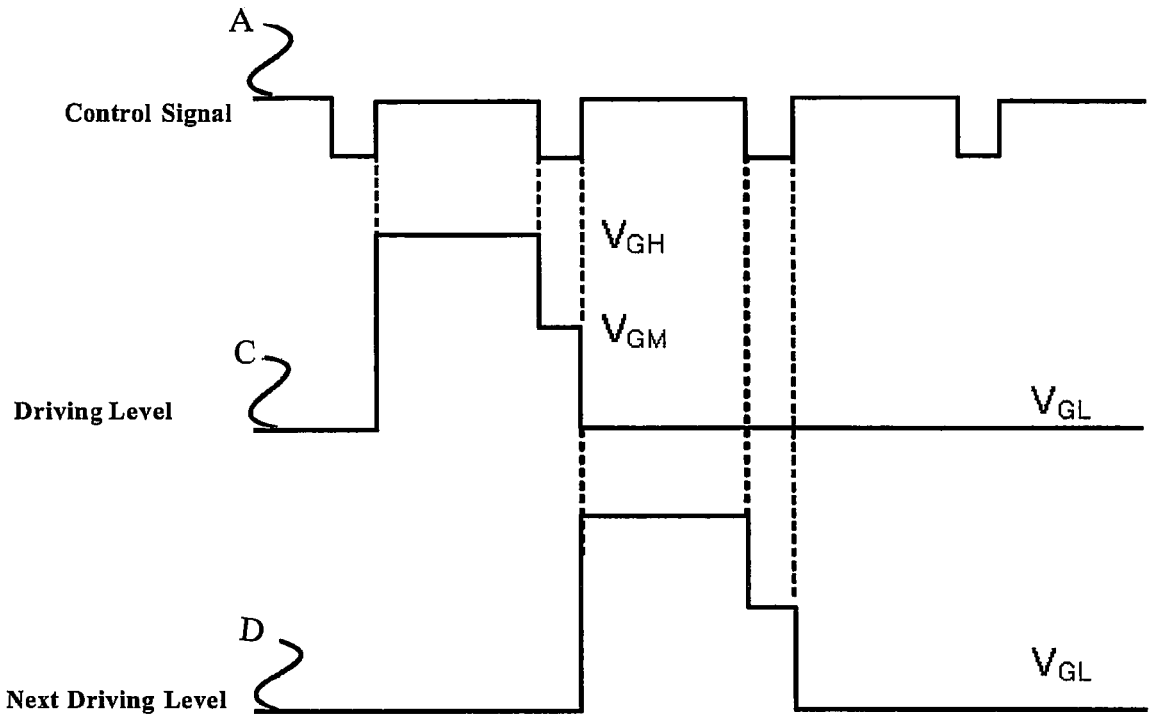
FIG. 7 is a timing waveform of the output signal of a gate driving integrated circuit.
Figure 9:
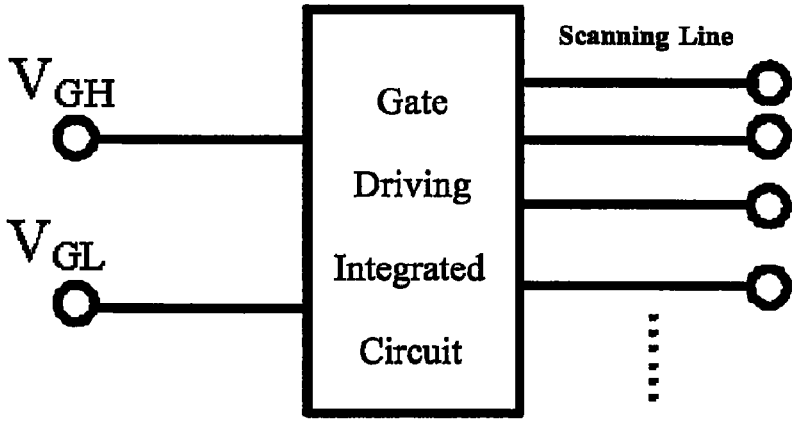
FIG. 9 is a diagram showing the connection ports for the gate driving integrated circuit according to the present invention.

As shown in FIG. 9, the signal output from the output terminal 122 is input as a high level $V_{GH}$ into the $V_{GH}$ terminal of the gate driving integrated circuit, and a negative level $V_{GL}$ which can turn off the TFTs in the display panel is further supplied to the gate driving integrated circuit. The high level $V_{GH}$ and the negative level $V_{GL}$ are processed by the gate driving integrated circuit and the output signal waveform is shown in FIG. 7, thus achieving the multilevel voltage driving of the TFTs in the LCD panel.

Figure 8:
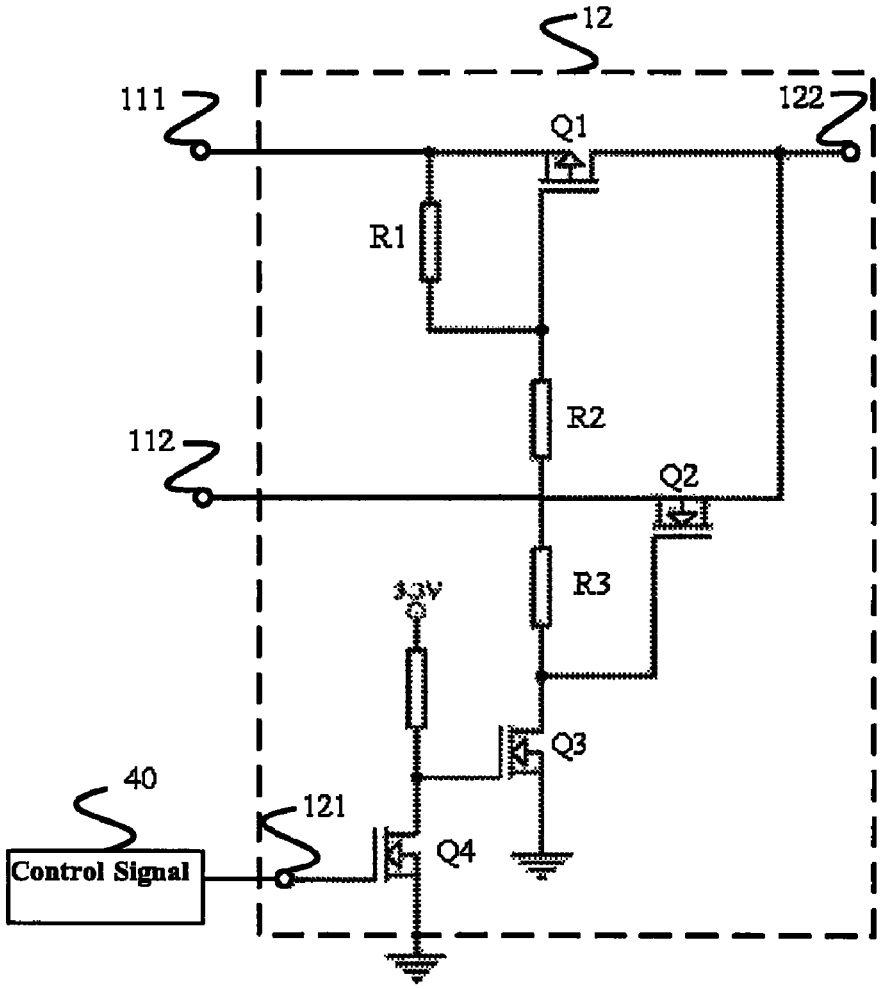
FIG. 8 is a diagram showing another circuit connection which can be adopted in the multilevel voltage driving device according to an embodiment of the present invention.

Besides, additional switch elements can be added correspondingly according to the polarity of the control signal. For example, if a control signal with an opposite polarity to that of the control signal in FIG. 6, as shown in FIG. 8, a fourth switch Q4 can be added to realize the output of desired driving voltage. In particular, the fourth switch Q4 can be a bipolar junction transistor, an FET, or other types of switch. In FIG. 8, the fourth switch Q4 is an N type FET.

Furthermore, the multilevel voltage driving device 10 in the embodiment can be incorporated to form a multilevel voltage driving system. As shown in FIG. 4, the multilevel voltage driving system comprises an AC signal source 20, which is connected with the AC signal input terminal 113 of the multilevel voltage driving device 10 for providing an AC signal, a reference level signal source 30, which is connected with the reference level input terminal 114 of the multilevel voltage driving device 10 for providing a DC reference level, and a control signal source 40, which is connected with the control signal input terminal 121 of the multilevel voltage driving device 10 for providing a control signal.

With the device and system according to the embodiments of the present embodiment, it is capable of generating driving levels having multilevel voltage, reducing flickering of the liquid crystal display panel, and improving the image quality. Compared with the driving device realized by an integrated operational amplifier in the conventional display panel, the multilevel voltage driving device or system of the present invention is realized by discrete components, and therefore has lower cost and lower power consumption.

Although the present invention has been described in detail herein with reference to the preferred embodiments, it should be understood by those skilled in the art that various modification and equivalents thereof can be made herein without departing from the spirit and scope of the present invention.

What is claimed is:

1. A multilevel voltage driving device, comprising:

a level converter, which is provided with an AC signal input terminal for inputting an AC signal, a high level output terminal for outputting a high level, and an intermediate level output terminal for outputting an intermediate level; and a switch selector, which is connected with the high level output terminal and the intermediate level output terminal, and which is provided with a control signal input terminal, for inputting a control signal to alternately select the high level and the intermediate level, and an output terminal for outputting the selected level;

wherein the level converter further comprises:

a reference level input terminal for inputting a reference level for the high level and the intermediate level;

two branches in parallel, two terminals of the branches being connected with the AC signal input terminal and ground, respectively, wherein one of the branches sequentially comprises a third capacitor, a first diode, and a first capacitor connected in series, and another one of the branches sequentially comprises a fourth capacitor, a second diode, and a second capacitor connected in series; and wherein one terminal of the first capacitor is connected with the ground and another terminal of the first capacitor is connected with a negative electrode of the first diode, one terminal of the second capacitor is connected with the ground and another terminal of the second capacitor is connected with a negative electrode of the second diode, the negative electrode of the first diode is connected with the intermediate level output terminal, and the negative electrode of the second diode is connected with the high level output terminal;

a third diode, wherein a positive electrode of the third diode is connected with the intermediate level output terminal, and a negative electrode of the third diode is connected with a positive electrode of the second diode; and a fourth diode, wherein a negative electrode of the fourth diode is connected with a positive electrode of the first diode, and a positive electrode of the fourth diode is connected with the reference level input terminal.

2. The multilevel voltage driving device according to claim 1, wherein the switch selector comprises:

a first switch and a second switch, wherein output terminals of the first switch and second switch are connected with each other, an input terminal of the first switch is connected with the high level output terminal, an input terminal of the second switch is connected with the intermediate level output level; and a third switch, of which a control terminal is connected with the control signal input terminal, an input terminal is connected with the ground, and an output terminal is connected with control terminals of the first switch and second switch.

3. The multilevel voltage driving device according to claim 2, wherein a first resistor is connected between the input terminal and the control terminal of the first switch.

4. The multilevel voltage driving device according to claim 2, wherein the output terminal of the third switch is connected with the control terminal of the first switch via a third resistor and a second resistor connected in series.

5. A multilevel voltage driving system comprising the multilevel voltage driving device according to claim 1 and further comprising an AC signal source which is connected with the AC signal input terminal of the multilevel voltage driving device.

6. The multilevel voltage driving system according to claim 5, further comprising a reference level signal source which is connected with the reference level input terminal of the multilevel voltage driving device.

7. The multilevel voltage driving system according to claim 5, further comprising a control signal source which is connected with the control signal input terminal of the multilevel voltage driving device.

* * * * *